US005539933A

United States Patent [19]

Garber et al.

[11] Patent Number: 5,539,933

[45] Date of Patent: Jul. 30, 1996

[54] BELT WITH TYING STRAP

[76] Inventors: Hal K. Garber; Karen L. Horstmanshof, both of 1221 Ashby NE., Grand Rapids, Mich. 49509

[21] Appl. No.: 245,204

[22] Filed: May 17, 1994

[51] Int. Cl.[6] ..... A41F 9/00

[52] U.S. Cl. ..... 2/311; 2/312; 2/321; 2/338

[58] Field of Search ..... 2/311, 312, 314, 2/315, 317, 318, 319, 321, 144, 148, 149, 151, 154, 155, 156, 338, 336; D2/624, 627, 629, 636, 156, 619

[56] References Cited

U.S. PATENT DOCUMENTS

D. 272,107 1/1984 Elliott et al. .
D. 282,789 3/1986 Remboldt .
D. 287,664 1/1987 Sherwood et al. .
D. 322,160 12/1991 Dauterive .
3,439,360 4/1969 Grubman ..... 2/155
3,506,978 4/1970 Santona ..... 2/156
4,472,839 9/1984 Johansen .
4,999,853 3/1991 Tanner .
5,081,714 1/1992 Liu ..... 2/311
5,115,519 5/1992 Dalrymple .
5,299,325 4/1994 Kamber et al. ..... 2/338

*Primary Examiner*—C. D. Crowder
*Assistant Examiner*—Gloria Hale
*Attorney, Agent, or Firm*—Varnum, Riddering, Schmidt & Howlett LLP

[57] ABSTRACT

A karate belt having a body to which is fixed a tying strap. The body of the karate belt is secured to the waist of a user independent of the tying strap. The tying strap remains free so that the user can practice tying a predetermined knot without being impeded or distracted by the need to simultaneously hold the belt about the user's waist while attempting to tie the knot.

12 Claims, 3 Drawing Sheets

BELT WITH TYING STRAP

BACKGROUND OF THE INVENTION

1. Field of the Invention

This invention relates to a belt and more particularly to a karate belt to aid in learning to tie a special knot.

2. Description of the Field of Invention

In the study of the martial arts, each student typically wears a robe that is held closed by a belt positioned around the student's waist and tied by a special knot. The knot is a part of the tradition in the study of the martial arts and is complex and difficult to tie. Normally, a student will learn to tie the knot by wrapping the belt around his or her waist and attempt to tie the complex knot while simultaneously holding the belt in place around the waist. Many students, especially young children, find it especially difficult, if not impossible, to tie the ends of the belt in the complex knot while simultaneously holding the belt about their waist, resulting in a substantial amount of time spent on practicing tying the knot instead of the martial art techniques. Therefore, it is desirable to have a belt that can be secured about the student's waist while leaving the free ends of the belt available so that the student can practice tying the knot without having to simultaneously hold the position of the belt.

SUMMARY OF INVENTION

The invention solves the problem of the prior martial arts belts by a belt that is fastened about the user's waist in such a manner that the ends of the belt remain free so that the student can practice tying the special knot.

The belt comprises an elongated strap having a front side and a rear side. The elongated strap terminates in a first and second end, respectively. A first fastener is positioned on the front side of a first end of the elongated strap and a second fastener is positioned on the rear side of a second end of the elongated strap. The fasteners are inter-engageable to secure the first end to the second end. A tying strap is attached at a central portion thereof to the front side of the elongated strap, preferably at the second end thereof. The tying strap has a length that is adapted to be tied into a karate knot, whereby the user of the belt can secure the belt to the user's waist by the fasteners and tie and untie the knot with the belt remaining secured to the user's waist.

Preferably, the belt is made from a suitable material, such as traditional karate belt cloth. The fasteners can be of the hook and loop type. The tying strap is sewn to the elongated body.

In another aspect of the invention, the belt comprises an elongated strap having a front side and a rear side. The elongated strap terminates in a first and second end, respectively. A first fastener is positioned on the front side of one end of the elongated strap and a second fastener is positioned on the rear side of the other end of the elongated strap. The fasteners are inter-engageable to secure the first end to the second end. A tying strap is attached at a central portion thereof to the front side of the elongated strap, preferably at the other end thereof. The tying strap is tied in a karate knot, whereby the user of the belt can secure the belt to the user's waist without having to tie the karate knot.

BRIEF DESCRIPTION OF THE DRAWINGS

The invention will now be described with reference to the drawings wherein.

DESCRIPTION OF THE PREFERRED EMBODIMENTS

Figure 1:
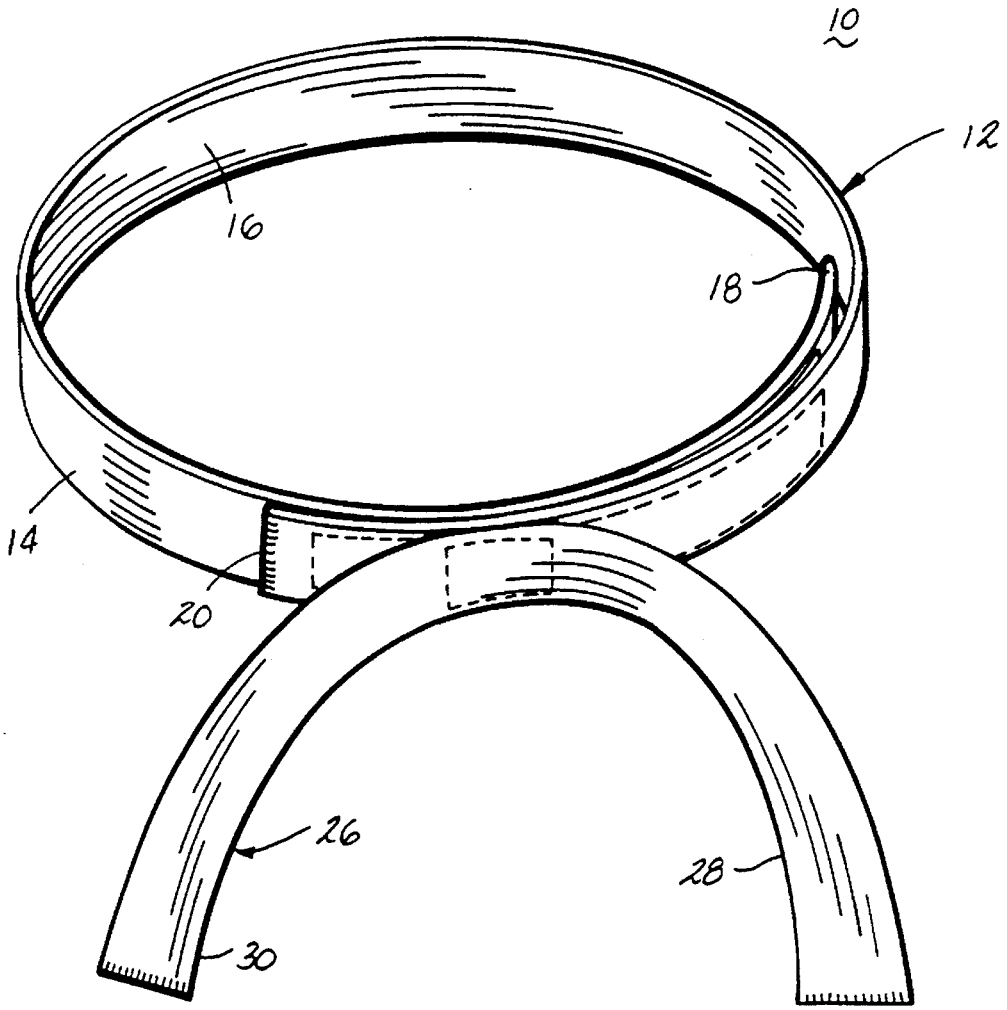
FIG. 1 is a perspective view of the training belt according to the invention in the fastened position and with the knot untied.
Figure 2:
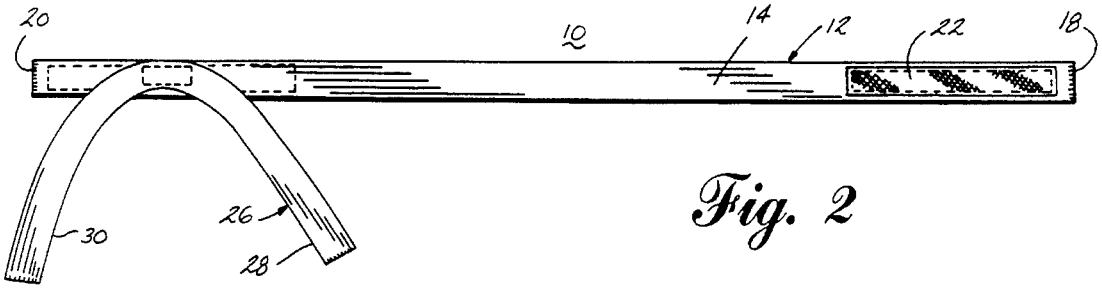
FIG. 2 is a front view of the training belt of FIG. 1 in the unfastened position.
Figure 3:
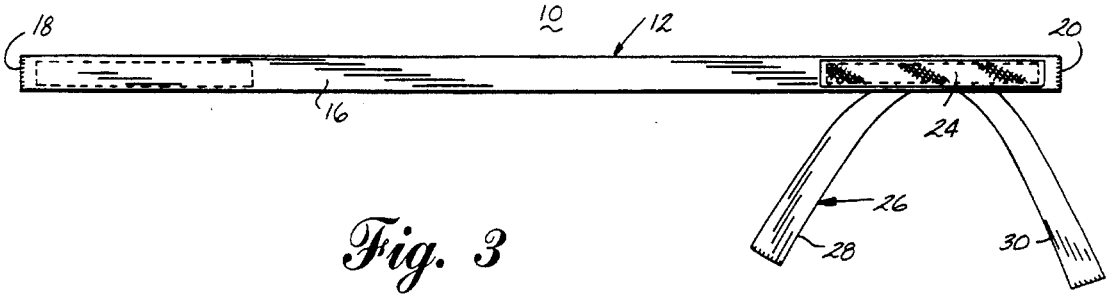
FIG. 3 is a rear view of the training belt of FIG. 2.

FIGS. 1–3 illustrate the belt 10 according to the invention. Preferably, the belt 10 is used in teaching martial arts students how to tie the complex knot that tradition requires of martial arts students and is useful as a karate belt. The belt 10 comprises a body 12 having a front side 14 and a rear side 16. The body is generally elongated and terminates at first and second ends 18 and 20. The belt 10 is preferably made of cloth, such as the traditional karate belt cloth.

The first and second ends 18, 20, respectively, are provided with means for securing the portions of the body 12 adjacent the ends 18, 20 to each other. Preferably, hook and loop fasteners 22 and 24, respectively, are mounted to the body 12 adjacent the first and second ends 18, 20, respectively, and secure the end portions of the body to each other. The hook and loop fasteners 22, 24 are preferably of sufficient length so that the belt 10 can accommodate a variety of waist sizes.

A tying strap 26 is mounted to the front side 14 of the body 12 adjacent the second end 20. The tying strap 26 is preferably sewn to body 12. However, the tying strap can be secured by any other suitable means such as, for example, hook-and-loop type fasteners or an adhesieve. The tying strap 26 can be conceptually separated into a left strap portion 28 and a right strap portion 30. The left strap portion 28 is disposed near the left hand of the student and the right strap portion 30 is disposed near the right hand of the student when the belt 10 is secured about the student's waist.

Figure 6:
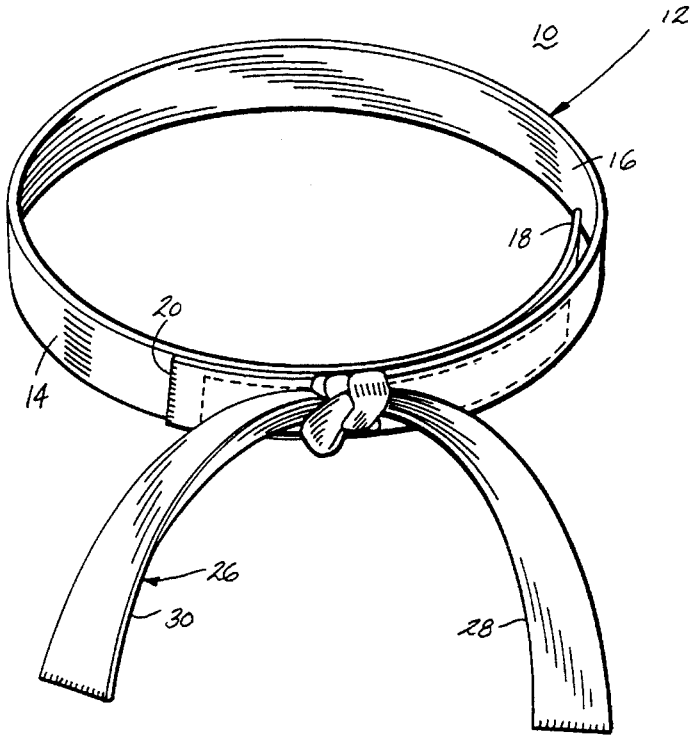
FIG. 6 is a perspective view of the belt of FIG. 1 illustrating the fastened position and with a knot tied in the belt.
Figure 4:
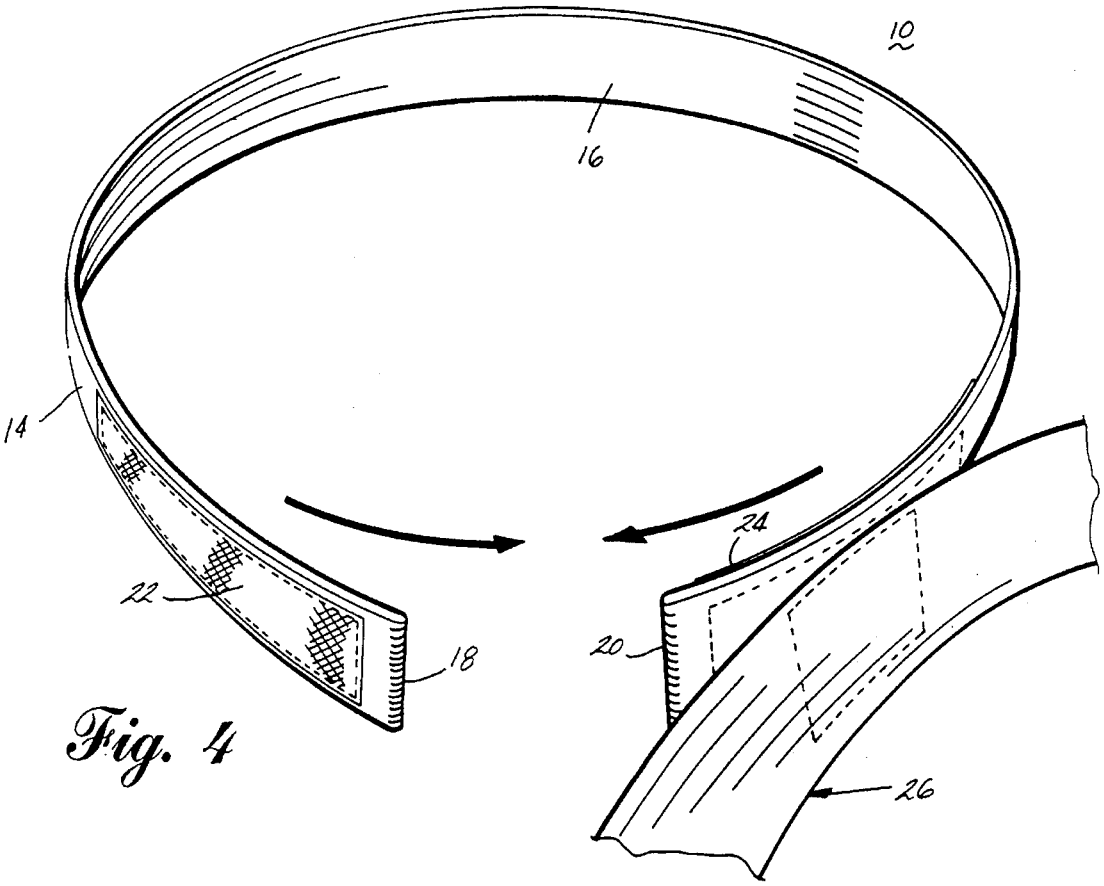
FIG. 4 is a perspective view of the training belt of FIG. 1 illustrating the wrapping of the training belt.
Figure 5:
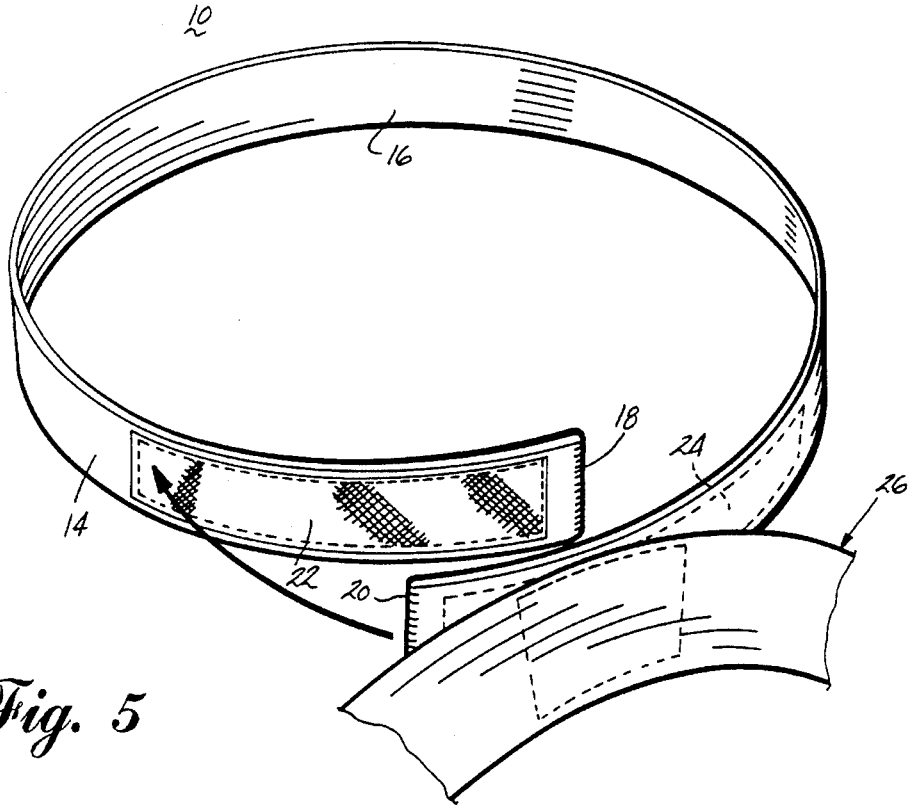
FIG. 5 is a perspective view of the training belt of FIG. 1 illustrating the securing of the training belt.

In operation, the student secures the body 12 of the belt 10 about her waist by wrapping the body about her waist and moving the first end 18 and the second end 20 toward each other, as illustrated in FIG. 4, until the hook and loop fastener 24 overlaps the hook and loop fastener 22. Once the hook and loop fasteners 22, 24 are in an overlapping relationship, the hook and loop fastener 24 is moved against the hook and loop fastener 22, as illustrated in FIG. 5, to secure the first end 18 to the second end 20 and the body 12 about the student's waist. In this position, the body 12 is fixed about the student's waist and the left and right strap portions 28, 30 of the tying strap 26 are freely suspended in front of the student so that the student can easily grasp the tying strap 26. Once the body 12 is secured about the student's waist, the student can then grasp the left strap portion 28 and right strap portion 30 and tie the complex knot as illustrated in FIG. 6. The student can continue to tie and untie the complex knot without being impeded and distracted by holding the belt 10 in a fixed position about the student's waist. Once the student is finished practicing, the student removes the training belt by grasping the second end 20 and pulling to separate the hook and loop fasteners 22, 24. Thus, the student significantly reduces the training time spent on tying the knot, freeing much more time for studying other aspects of the martial arts.

The belt 10 is useful as a karate belt. The belt 10 is constructed to look like a karate belt with the knot tied. Thus, after the knot is tied, one can attach the two ends of the belt together and use the belt as a karate belt. The knot need not be untied. It can remain tied between times of use.

While particular embodiments of the invention have been shown, it will be understood, of course, that the invention is not limited thereto since modifications may be made by those skilled in the art, particularly in light of the foregoing teachings. For example, although the training belt is described in the context of the martial arts, the training belt can be used in other applicable situations. Reasonable variation and modification are possible within the scope of the foregoing disclosure of the invention without departing from the spirit of the invention.

The embodiments of the invention in which an exclusive property or privilege is claimed are defined as follows:

1. A belt comprising an elongated strap of sufficient length to fit around a user's waist with first and second ends and a front side and a rear side, a first fastener on the front side of the first end and a second fastener on the rear side of the second end, the fasteners being inter-engageable to secure the first end to the second end, and a tying strap of the same material as the elongated strap attached at a central portion thereof to the front side of the second end of the elongated strap, the tying strap having a length adapted to be tied into a karate knot, whereby a user can secure the belt around the user's waist by the fasteners and tie and untie the tying strap into a karate knot without a need to support the belt.

2. A belt according to claim 1 wherein the elongated strap and tying strap are made entirely of a karate belt cloth.

3. A belt according to claim 1 wherein the first and second fasteners are hook-and-loop fasteners.

4. A belt according to claim 1 wherein the tying strap is sewn to the elongated strap.

5. A belt comprising an elongated strap of sufficient length to fit around a user's waist with first and second ends and a front side and a rear side, a first fastener on the front side of the first end a second fastener on the rear side of the second end, the fasteners being inter-engageable to secure the first end to the second end, and a tying strap of the same material as the elongated strap attached at a central portion thereof to the front side of the second end of the elongated strap, the typing strap being tied in a karate knot, whereby a user can secure the belt to the user's waist without having to tie the karate knot.

6. A belt according to claim 5 wherein the elongated strap and the typing strap are made entirely of a karate belt cloth.

7. A belt according to claim 5 wherein the fasteners are hook-and-look fasteners.

8. A belt according to claim 5 wherein the tying strap is sewn to the elongated strap.

9. A belt according to claim 1 wherein the elongated strap is made entirely from an inelastic cloth material.

10. A belt according to claim 5 wherein the elongated strap is made entirely of an inelastic cloth material.

11. A method of securing a karate belt to a user, the method comprising:

providing an elongated strap of sufficient length to fit around a user's waist with first and second ends and a front side and a rear side;

providing a first fastener on the first end of the elongated strap and a second fastener on the second end of the elongated strap, the fasteners being inter-engageable to secure the first end to the second end;

attaching a tying strap of the same material as the elongated strap at a central portion thereof to the front side of the elongated strap, the tying strap having a length adapted to be tied into a karate knot;

tying a karate knot with the tying strap;

positioning the elongated strap around a user's waist such that the tying strap is in front of the user; and securing the first end to the second end around the waist of a user by inter-engaging the first and second fasteners.

12. A karate belt comprising an elongated strap of a karate belt material of sufficient length to fit around a user's waist with first and second ends and a front side and a rear side, a first fastener on the first end and a second fastener on the second end, the fasteners being inter-engageable to secure the first end to the second end, and a tying strap of said karate belt material attached at a central portion thereof to the front side of the elongated strap, the tying strap being tied in a karate knot and end portions of said tying strap extending from said karate knot, whereby a user can secure the belt to the user's waist without having to tie the karate knot.

* * * * *